US007004241B2

(12) United States Patent
Smithey et al.

(10) Patent No.: US 7,004,241 B2
(45) Date of Patent: Feb. 28, 2006

(54) FLEXIBLE TUBE ARRANGEMENT-HEAT EXCHANGER DESIGN

(75) Inventors: David W. Smithey, Adrian, MI (US); Milan A. Virsik, Adrian, MI (US)

(73) Assignee: Brazeway, Inc., Adrian, MI (US)

( * ) Notice: Subject to any disclaimer, the term of this patent is extended or adjusted under 35 U.S.C. 154(b) by 145 days.

(21) Appl. No.: 10/696,913

(22) Filed: Oct. 30, 2003

(65) Prior Publication Data

US 2005/0092473 A1 May 5, 2005

(51) Int. Cl.
*F28D 1/047* (2006.01)

(52) U.S. Cl. ..... 165/151; 29/890.047

(58) Field of Classification Search ..... 165/151, 165/152; 29/890.047
See application file for complete search history.

(56) References Cited

U.S. PATENT DOCUMENTS

| | | | | |
|---|---|---|---|---|
| 2,437,452 | A * | 3/1948 | Baird | 165/151 |
| 2,462,511 | A | 2/1949 | Kramer | |
| 2,672,324 | A | 3/1954 | Weiss | |
| 3,780,799 | A | 12/1973 | Pasternak | |
| 3,781,960 | A * | 1/1974 | Hoek | 29/890.047 |
| 4,053,014 | A | 10/1977 | Neff et al. | |
| 4,434,843 | A | 3/1984 | Alford | |
| 4,492,851 | A * | 1/1985 | Carr | 165/181 |
| 4,580,623 | A | 4/1986 | Smitte et al. | |
| 4,778,004 | A | 10/1988 | Paulman et al. | |
| 5,183,105 | A | 2/1993 | Adams | |
| 5,535,820 | A | 7/1996 | Beagle et al. | |
| 5,540,276 | A | 7/1996 | Adams et al. | |
| 5,853,259 | A * | 12/1998 | Murray, Jr. | 402/3 |
| 6,253,839 | B1 | 7/2001 | Reagen et al. | |
| 6,370,775 | B1 | 4/2002 | Reagen et al. | |
| 6,598,295 | B1 * | 7/2003 | Utter | 165/151 |

FOREIGN PATENT DOCUMENTS

| | | | |
|---|---|---|---|
| JP | 58-110142 | * | 6/1983 |
| JP | 5-87480 | * | 4/1993 |

* cited by examiner

*Primary Examiner*—Teresa J. Walberg
(74) *Attorney, Agent, or Firm*—Harness, Dickey & Pierce, P.L.C.

(57) ABSTRACT

A universal fin for use on a heat exchanger having a known number of vertical and horizontal tube passes. The universal fin has a plurality of openings arranged in equally spaced columns and equally spaced rows. One or more continuous fins having columns and rows of openings equal to the known number of tube passes can be removed from the universal fin and assembled with a tube portion to form the heat exchanger. The openings on the universal fin are configured so that one or more fins can be separated from the universal fin for use on a heat exchanger regardless of the number of horizontal and vertical passes that comprise the heat exchanger.

30 Claims, 11 Drawing Sheets

FLEXIBLE TUBE ARRANGEMENT-HEAT EXCHANGER DESIGN

FIELD OF THE INVENTION

The present invention relates to heat exchangers, and more particularly to universal fins that can be used in fin on tube heat exchangers.

BACKGROUND OF THE INVENTION

Heat exchangers are used in a wide variety of applications and come in a wide variety of configurations to fit these various applications. One particular application in which heat exchangers are used is as condensers in refrigeration cabinets. The condensers in the refrigeration cabinets can come in a variety of configurations. When a condenser is installed underneath the refrigeration cabinet, the heat exchanger is generally a wire-on-tube condenser. These condensers underneath the refrigeration cabinet have a much larger horizontal dimension then vertical dimension, assuming a horizontal air flow. When the condensers are installed in the machine compartment of the refrigeration cabinet, the condensers will have a larger vertical dimension than horizontal dimension, assuming a horizontal air flow. Because these condensers have a larger vertical dimension then horizontal dimension, the configuration of these condensers is typically that of a jelly-roll condenser or a multi-layer wire-on-tube configuration. Therefore, the configuration of the condenser in a refrigeration cabinet can vary depending on whether the condenser is positioned underneath the refrigeration cabinet or within a machine compartment of the cabinet.

Because the configurations vary, a manufacturer of refrigeration cabinets must have available a variety of heat exchanger configurations dependent on where the condenser is to be placed. In an effort to simplify the manufacturing process and to reduce cost, it would be desirable to have a common condenser configuration that can be used in either location. It would be further desirable if the common condenser configuration can utilize a universal fin that could be cut or separated to form one or more fins for either configuration regardless of the vertical or horizontal dimensions of the condenser configuration.

In domestic refrigerators, heat exchangers are used to form both evaporators and condensers. When the heat exchangers are configured to be evaporators in domestic refrigerators, they have a relatively small inlet for air and a comparably long air path through the evaporator. That is, assuming a vertical airflow, the evaporators are configured to have a much larger vertical dimension than horizontal dimension.

The heat exchangers that are typically configured to perform as either evaporators or condensers for domestic refrigerators use a tube and fin pattern that is different depending upon whether the heat exchangers are configured as evaporators or condensers. The different configurations do not allow for the use of a common fin to make the heat exchangers. Therefore, a manufacturer of these heat exchangers must maintain not only different configurations but also a variety of fin patterns that can be used on the differing configurations of the heat exchangers. It would be desirable if the configurations of the heat exchangers were similar enough that a universal or common fin pattern could be used to provide fins for the heat exchanger regardless of whether the heat exchangers are configured as condensers or as evaporators. The use of a universal or common fin pattern will reduce the cost of manufacturing the heat exchanger by reducing the variety of fins the manufacturer of heat exchangers will be required to produce and/or stock and reducing the capital investment required to purchase and maintain stamping dies for each different fin pattern.

Therefore, it would be desirable to provide a heat exchanger that can be configured with either a larger number of tube passes parallel to the airflow or tube passes perpendicular to the airflow and that will utilize the same universal or common fin pattern. The use of a common or universal fin pattern thereby reduces the cost to manufacture and provide heat exchangers of varying configurations. Additionally, it would be desirable if the tube pattern were such that the tube passes were oriented relative to the airflow for an optimal or highly efficient heat transfer.

SUMMARY OF THE INVENTION

The present invention allows for the construction of heat exchangers that can be configured as either evaporators or condensers and utilize a common or universal fin regardless of the number of vertical and horizontal tube passes in the heat exchangers. A universal fin for use in a fin on tube heat exchanger according to the principles of the present invention includes a sheet of heat conducting material that is configured to be separated to form one or more fins for use on the fin on tube heat exchanger regardless of a number of vertical and horizontal pairs of tubing segments in the heat exchanger. The sheet has a width and a height. There are a plurality of openings in the sheet. Each of the openings is configured to allow a pair of generally parallel tubing segments of the heat exchanger to pass therethrough. The openings are canted relative to the width and height of the sheet. The openings are arranged on the sheet into a plurality of rows and a plurality of columns with adjacent rows being generally equally spaced apart and adjacent columns being generally equally spaced apart. The spacing between adjacent rows and adjacent columns is dimensioned to allow the sheet to be separated between at least one of the adjacent rows and the adjacent columns to form one or more fins that each contain a plurality of openings at least equal to a number of pairs of tubing segments in the heat exchanger.

A fin on tube heat exchanger having a fin formed from a universal fin sheet is also disclosed. The heat exchanger includes a tube portion having a plurality of straight segments of tubing interconnected by a plurality of connecting segments of tubing with each connecting segment interconnecting two straight segments. The straight and connecting segments are arranged in a sinuous configuration. The tube portion has a known quantity of vertical and horizontal pairs of tube passes. There is at least one fin on the tube portion. The fin is separated from a universal fin sheet having a width, a height and a plurality of openings with each opening configured to allow a pair of tube passes to pass therethrough. The openings are arranged on the universal fin sheet into a plurality of rows and a plurality of columns with adjacent rows being generally equally spaced apart and adjacent columns being generally equally spaced apart. The spacing between adjacent rows and adjacent columns is dimensioned so that the universal fin sheet can be separated between at least one of the adjacent rows and adjacent columns to form the fin having a quantity of openings at least equal to the number of pairs of tube passes regardless of a number of vertical and horizontal pairs of tube passes in the tube portion. The fin formed thereby has a quantity of openings at least equal to the number of pairs of tube passes in the tube portion and is arranged on the tube portion with each pair of tube passes of the tube portion passing through one of the openings in the fin.

The present invention also discloses a method of making a fin on tube heat exchanger. The method includes: (1) separating at least one fin having a predetermined quantity of openings from a preformed universal fin sheet that is configured to be separated to provide one or more fins for use on a heat exchanger regardless of a number of vertical and horizontal pairs of tube passes in a tube portion of the heat exchanger on which the at least one fin is to be used; and (2) positioning the fin on the tube portion of the heat exchanger with pairs of tube passes passing through the openings.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1A:
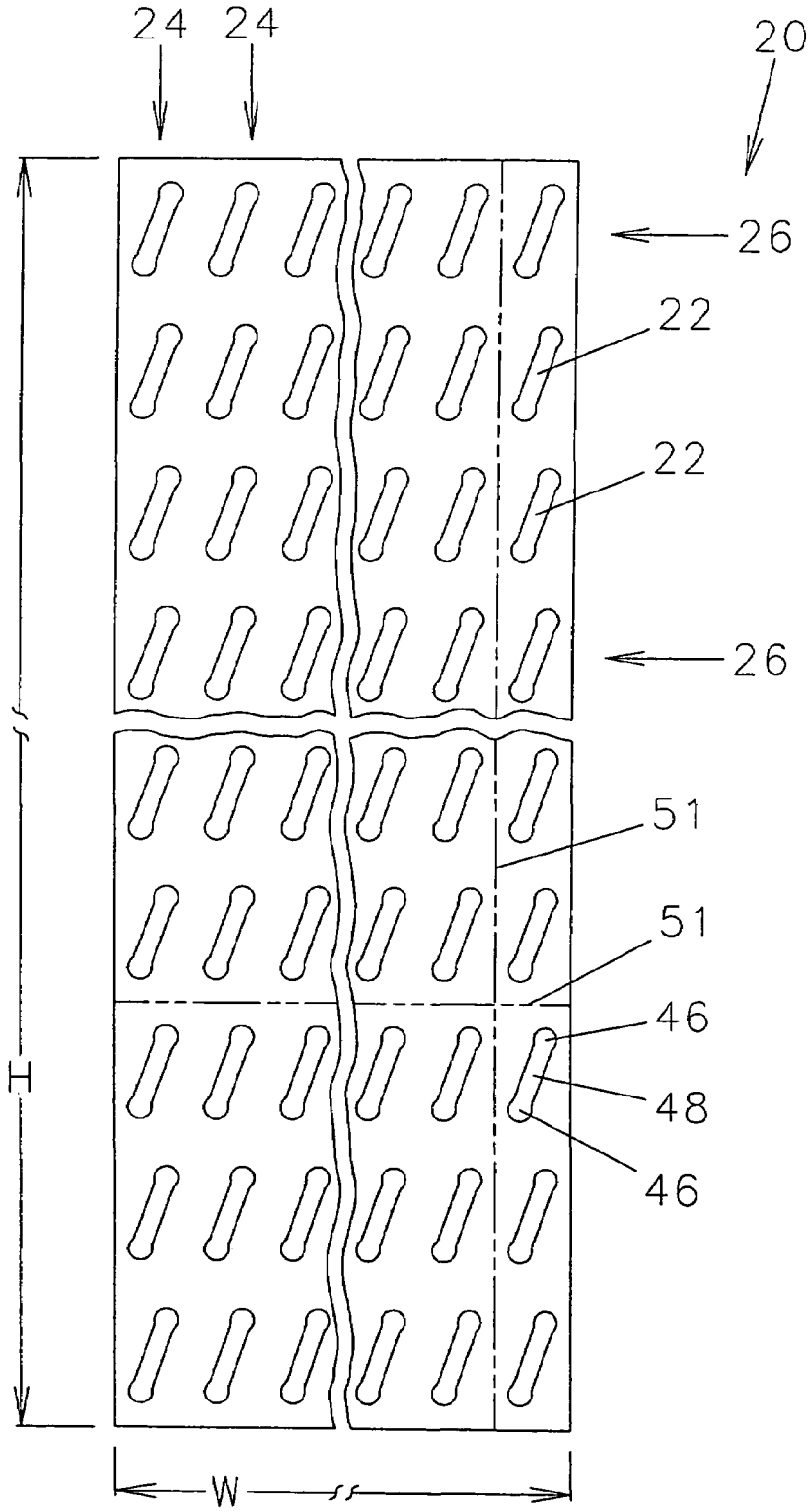
FIG. 1A is a front elevation view of a universal fin according to the principles of the present invention.

Referring now to FIG. 1A, there is shown a universal fin 20 in accordance with the principles of the present invention. The universal fin 20 has a plurality of openings 22 that are each configured and adapted to allow tube passes on a heat exchanger to pass therethrough when the universal fin 20 or a portion of the universal fin 20 is used as a fin on a fin on tube heat exchanger, as will be explained in more detail below. The universal fin 20 has a height H and a width W. The openings 22 are arranged into a plurality of columns 24 and a plurality of rows 26. The columns 24 and the rows 26 are spaced apart such that the universal fin 20 can be separated between the columns 24 or between the rows 26 to form one or more fins 28, such as those shown in FIGS. 1B and 1C, for use on a tube portion 30, such as that shown in FIG. 2, of a fin on tube heat exchanger 32, as will be discussed in more detail below.

Figure 2:
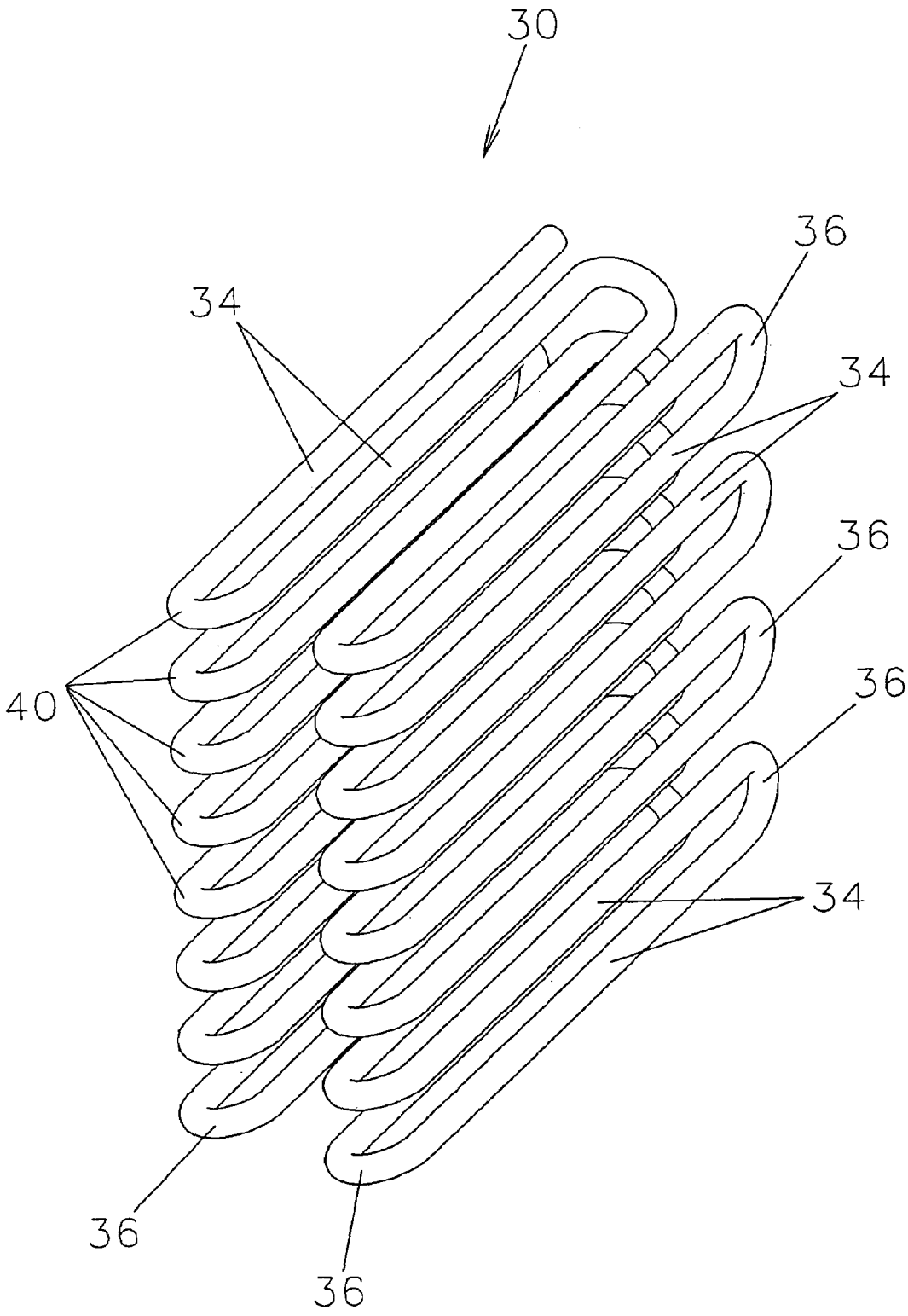
FIG. 2 is a perspective view of a tube portion of a heat exchanger according to the principles of the present invention.

Referring now to FIG. 2, there is shown a tube portion 30 that can be used to make a fin on tube heat exchanger 32 according to the principles of the present invention. The tube portion 30 is comprised of a plurality of straight segments 34 and a plurality of connecting segments 36. Each connecting segment 36 interconnects two straight segments 34 so that all of the straight segments 34 are interconnected and form the tube portion 30 for use in the heat exchanger 32. The tube portion 30, as is known in the art, has at least one internal passageway (not shown) that allows a fluid to flow through the tube portion 30.

Figure 3:
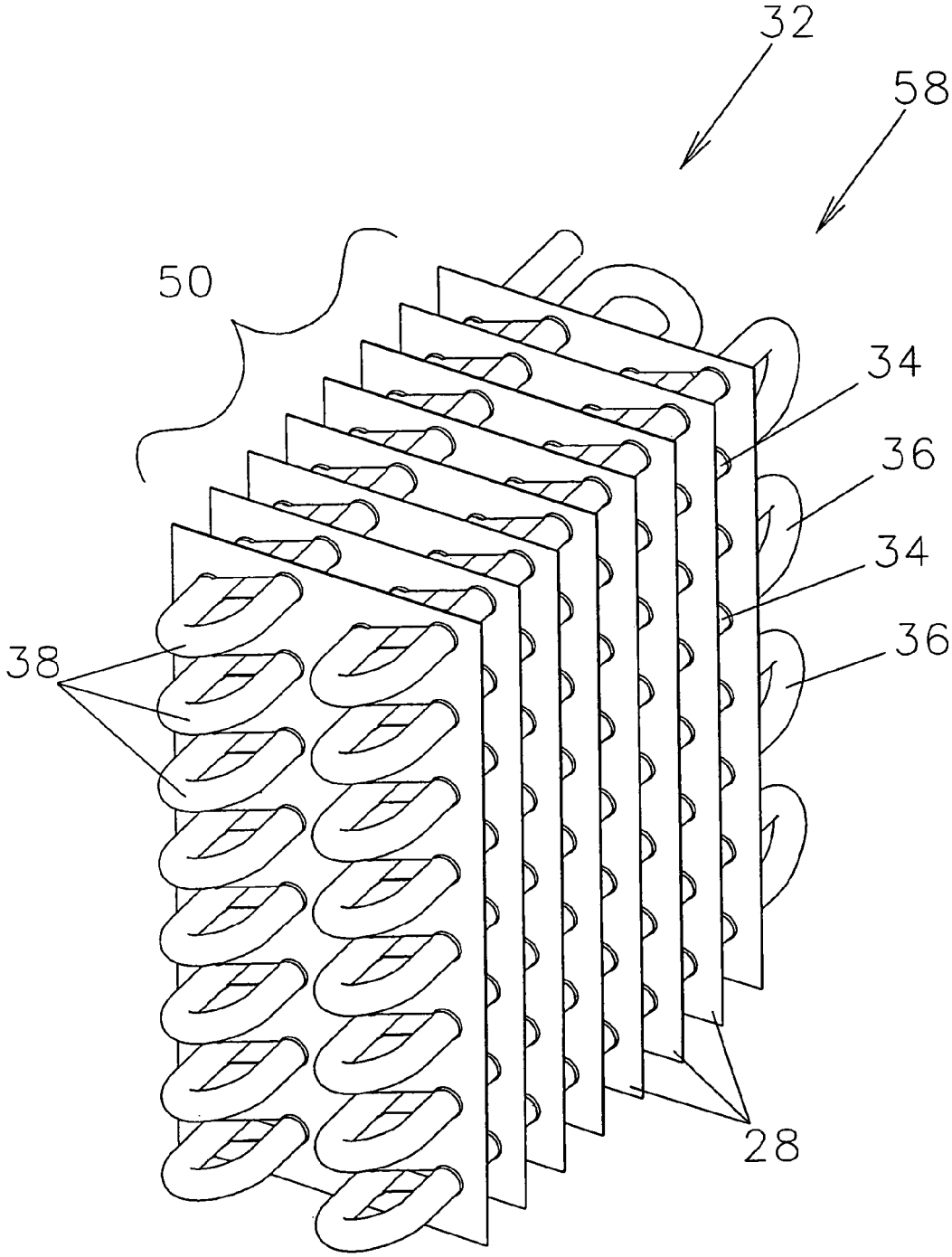
FIG. 3 is a perspective view of a heat exchanger according to the principles of the present invention having more vertical tube passes than horizontal tube passes.
Figure 4:
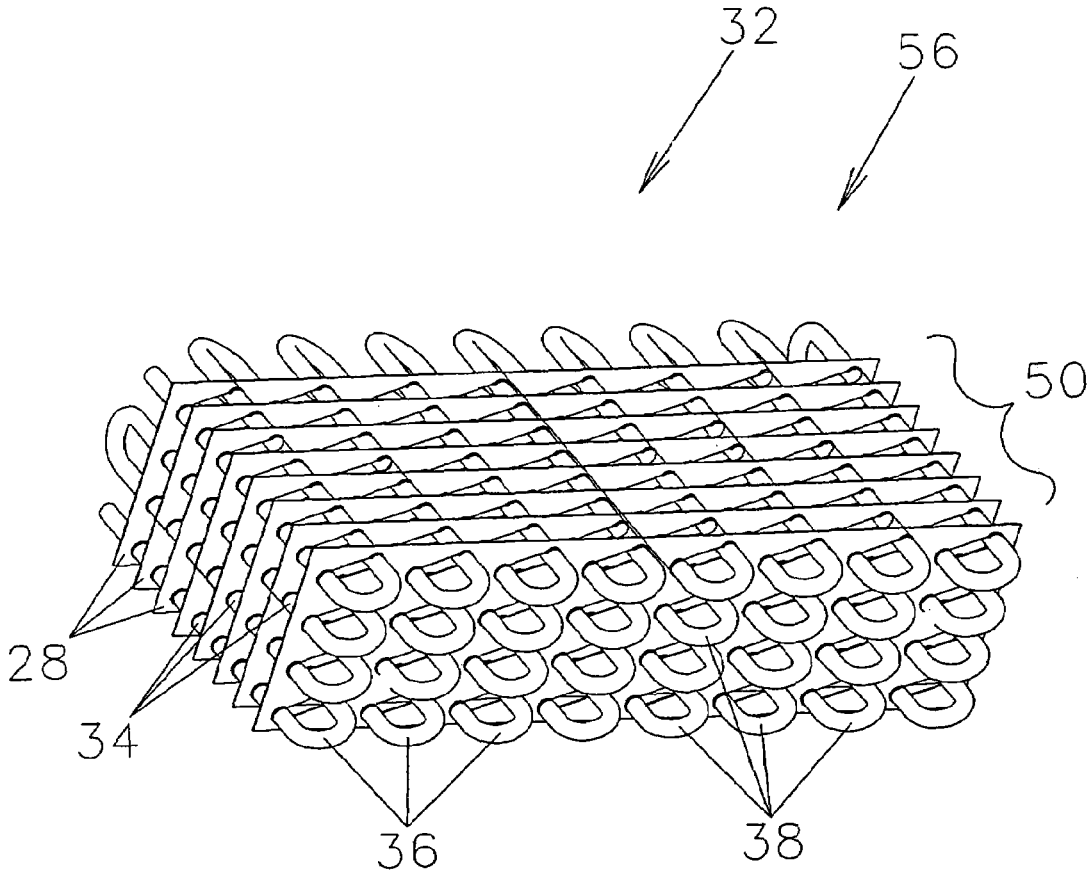
FIG. 4 is a perspective view of a heat exchanger according to the principles of the present invention having more horizontal tube passes than vertical tube passes.

The tube portion 30 has a plurality of horizontal and vertical tube passes 38. A tube pass 38 is defined as the part of the tube portion 30 that passes through a common opening 22 in a fin 28. The tube portion 30 will be configured for the specific application in which the heat exchanger 32 is desired to be used. That is, the number of vertical and horizontal tube passes 38 will vary depending upon the application in which the heat exchanger 32 formed from the tube portion 30 is to be used. For example, as shown in FIGS. 2 and 3, the tube portion 30 can be configured to have two horizontal tube passes 38 and eight vertical tube passes 38 (a 2×8 configuration) or, as shown in FIG. 4, the tube portion 30 can be configured to have eight horizontal tube passes 38 and four vertical tube passes 38 (an 8×4 configuration). Preferably, the tube portion 30 is configured so that the tube passes 38 are canted so that the heat exchanger 32 formed from the tube portion 30 efficiently transfers heat.

Each tube pass 38 is comprised of a pair 40 of straight segments 34 which pass through all or a portion of the fins 28 on the heat exchanger 32. The two straight segments 34 are interconnected by a connecting segment 36. The straight segments 34 and the connecting segments 36 are formed into a sinuous or serpentine tube portion 30, as is known in the art, to be used in the heat exchanger 32. Preferably, each straight segment 34 that forms a pair 40 of straight segments are parallel to one another. Even more preferably, all the straight segments 34 that comprise tube passes 38 are generally parallel. A single straight segment 34 could also pass through all or a portion of each fin 28 on the heat exchanger 32.

Preferably, the tube portion 30 is configured so that adjacent horizontal tube passes 38 are uniformly spaced apart. Also preferably, adjacent vertical tube passes 38 are uniformly spaced apart. Even more preferably, the spacing between adjacent horizontal tube passes 38 is generally the same as the spacing between adjacent vertical tube passes 38. The uniform spacing between adjacent horizontal and vertical tube passes 38 enables the universal fin 20 to provide one or more fins 28 to be used with the tube portion 30 to form heat exchangers 32 regardless of the number of horizontal and vertical tube passes 38, as will be described in more detail below.

Figure 7:
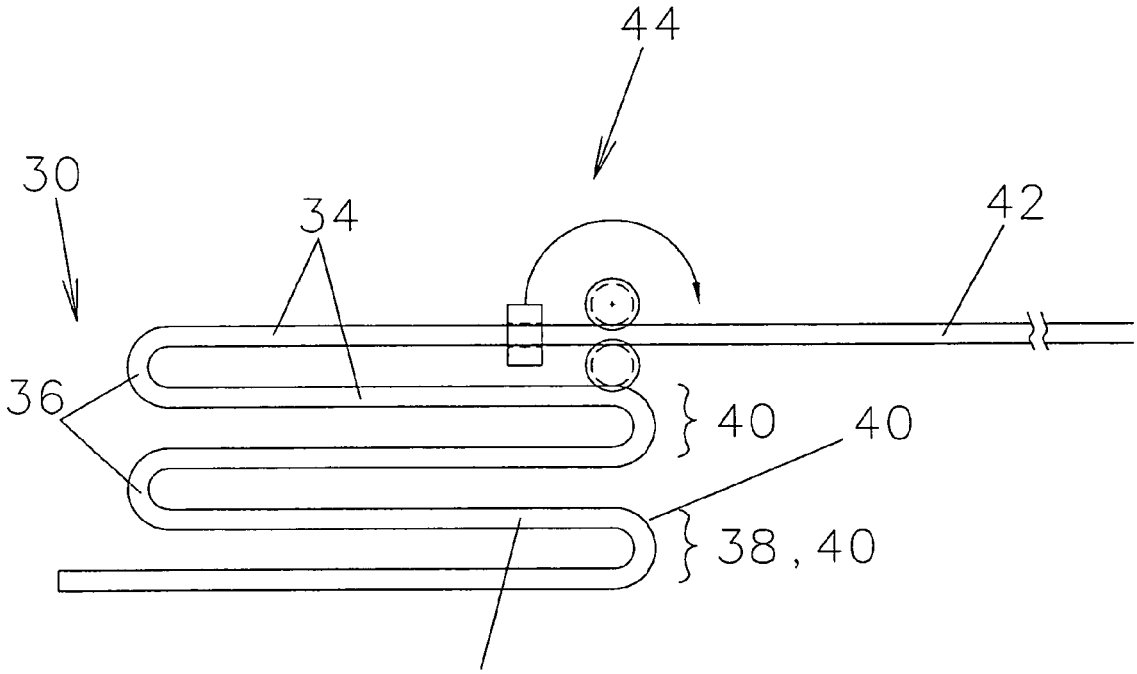
FIG. 7 is a perspective view of the tube portion of FIG. 2 being formed by bending a length of continuous tubing.

The tube portion 30 can be made in a variety of manners. For example, as shown in FIG. 7, the tube portion 30 can be made by bending a piece of continuous tubing 42 into the desired configuration. While the piece of continuous tubing 42 is shown in FIG. 7 as being bent by a tube bender 44, it should be understood that other methods of bending a piece of continuous tubing 42 into a tube portion 30 having a desired configuration, as will be apparent to those skilled in the art, can be employed and still be within the scope of the invention as defined by the claims. Alternatively, the tube portion 30 can be formed by connecting independent straight segments 34 with independent connecting segments 36. That is, the tube portion 30, as is known in the art, can be assembled from a plurality of discreet components. The connecting segments 36 can be connected to the straight segments 34 by brazing, adhesives, or other means known in the art, without departing from the scope of the invention as defined by the claims. The connecting segments 36, regardless of being discrete components or part of the tube is slightly flattened in a rectangular die (not shown) to facilitate insertion through openings 22 in universal fin 20.

Referring now to FIG. 1A, it can be seen that the openings 22 in the universal fin 20 are configured to allow a tube pass 38 to pass therethrough. That is, the openings 22 are configured to allow a pair 40 of straight segments and a slightly flattened connecting segment 36 to pass through the opening 22. The openings 22, are comprised of end portions 46 connected by a central portion 48. The end portions 46 are rounded and substantially complementary to the straight segments 34 that make up the tube portion 30. End portions 34 have a collar or flange portion 49 (shown in FIG. 6 only) that contacts straight segments 34. End portions 46 have a radius that is slightly less than a radius of the straight segments 34 to allow a press-fit connection with good surface contact between straight segments 34 and fins 28. The central portion 48 connects the end portions 46 and allows the slightly flattened connecting segment 36 attached to the pair of straight segments 40 to pass therethrough so that a fin 28 having the openings 22 can be positioned on a tube portion 30 with each tube pass 38 passing through different openings 22 to form a heat exchanger 32. Preferably, the end portions 46 and the intermediate portion 48 are configured to form a "dog-bone" shape, as is known in the art. Even more preferably, each opening 22 in the universal fin 20 is generally identical. The openings 22 are canted relative to the height H and width W. The tube portion 30 is configured so that the tube passes 38 are also canted and are complementary to the canting of the openings 22.

As was stated above, the universal fin 20 is configured so that one or more fins 28 can be separated from the universal fin 20 and used on a heat exchanger 32 regardless of the number of horizontal or vertical tube passes 38 that comprise the heat exchanger 32. To enable the universal fin 20 to provide one or more fins 28 for use on a heat exchanger 32 regardless of the number of horizontal and vertical tube passes 38, the spacing between the openings 22 on the universal fin 20 generally need to be the same as the spacing between the tube passes 38 on a tube portion 30. Preferably, adjacent columns 24 of openings 22 are generally equally spaced apart. Also preferably, adjacent rows 26 of openings 22 are generally equally spaced apart. The tube portion 30 is configured so that the spacing between vertical tube passes 38 is generally the same as the spacing between adjacent rows 26 of openings 22 in the universal fin 20 and the spacing between horizontal tube passes 38 is generally the same as the spacing between adjacent columns 24 of openings 22 in the universal fin 20.

Figure 1B:
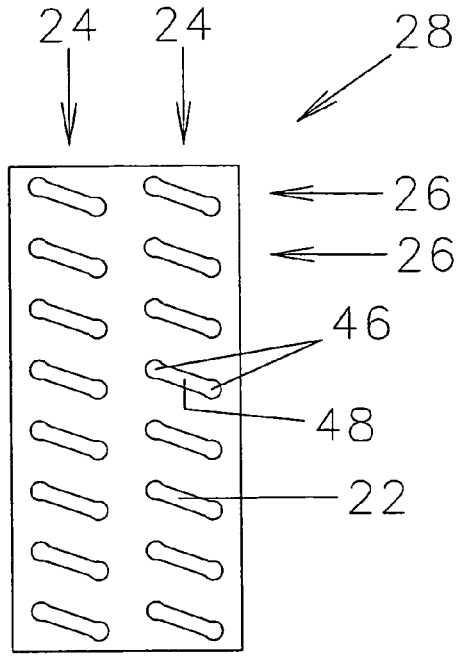
FIGS. 1B and 1C are front elevation views of continuous fins that can be formed from the universal fin in FIG. 1A.
Figure 1C:
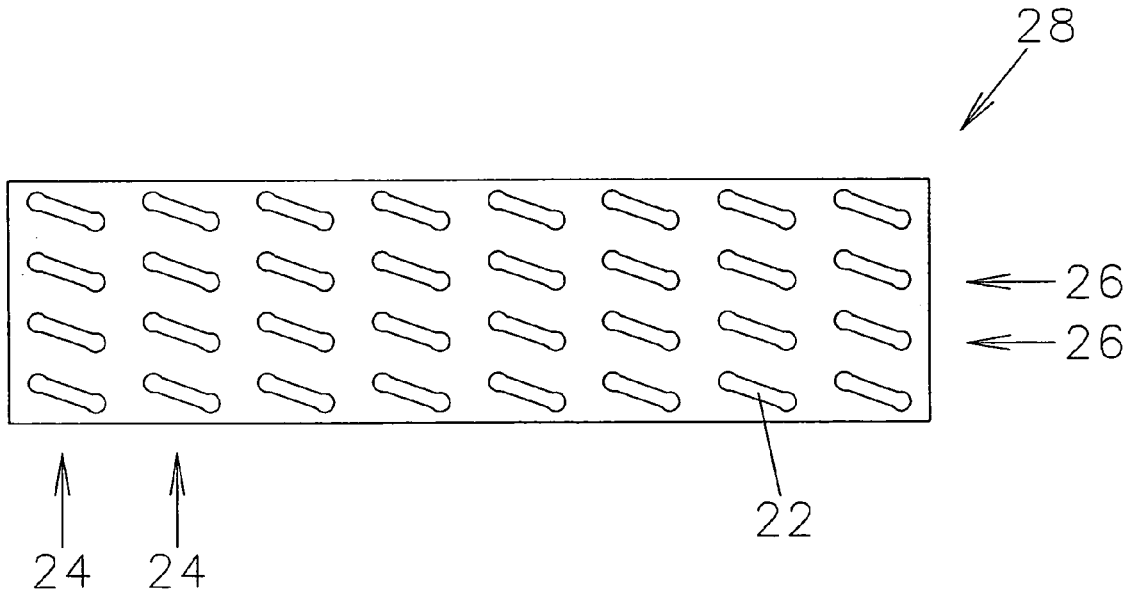

Because the tube portion 30 is configured so that the spacing between vertical and horizontal tube passes 38 are the same as the spacing between the columns 24 and the rows 26, the universal fin 20 can be separated between the rows 26 and/or columns 24 to form one or more continuous fins 28 that can be used on the tube portion 30 to form a heat exchanger 32 regardless of the number of horizontal and vertical tube passes 38. For example, when the tube portion 30 is configured into the shape shown in FIGS. 2 and 3, the tube portion 30 has two horizontal tube passes 38 and eight vertical tube passes 38, a 2×8 configuration. To make a continuous fin 28 for use on the 2×8 configuration, the universal fin 20 is separated between adjacent columns 24 and adjacent rows 26 so that a continuous fin 28, as shown in FIG. 1B, is formed that has two columns 24 of openings 22 and eight rows 26 of openings 22. The fin 28, shown in FIG. 1B, can then be used on the tube portion 30 shown in FIG. 2 to form the heat exchanger 32 shown in FIG. 3. The universal fin 20 can also be used to provide one or more continuous fins 28 for use on a tube portion 30 having eight horizontal tube passes 38 and four vertical tube passes 38, an 8×4 configuration, as shown in FIG. 4. A fin 28 for use on the tube portion 30 shown in FIG. 4 can be separated from the universal fin 20. That is, the universal fin 20 is separated between adjacent columns 24 and adjacent rows 26 to form a continuous fin 28, as shown in FIG. 1C, that has eight columns 24 of openings 22 and four rows 26 of openings 22. The fin 28 shown in FIG. 1C can then be used on a tube portion 30 shown in FIG. 4 to form the heat exchanger 32 shown in FIG. 4.

Preferably, the universal fin 20 is separated so as to form a plurality of continuous fins 28 having the same number of columns 24 and rows 26 so that the plurality of fins 28 can be aligned to form a fin bank 50 through which the tube passes 38 of the tube portion 30 pass. That is, the plurality of fins 28 formed from a universal fin 20 are positioned on the tube portion 30 and spaced along the tube passes 38 to form an efficient heat exchanger 32. It should be appreciated that the universal fin 20 can be separated so as to form continuous fins 28 having more or less number of columns 24 and/or rows 26 than the number of horizontal and/or vertical tube passes 38 if desired and still be within the scope of the present invention.

Optionally, to facilitate the separation of the universal fin 20 to form one or more continuous fins 28, the universal fin 20 can be provided with indicia 51 that extends between the adjacent columns 24 and/or between adjacent rows 26. The indicia 51 indicates locations on the universal fin 20 where the universal fin 20 can be separated to form the one or more fins 28. The indicia 51 can be perforations in the universal fin 20. The perforations facilitate the separating of the one or more fins 28 from the universal fin 20.

The one or more continuous fins 28 formed from the universal fin 20 are assembled on the tube portion 30 by either sliding the tube passes 38 through the openings 22 until the fins 28 are positioned in desired locations on the tube portion 30, or by sliding the fins 28 along the tube passes 38 until the fins 28 are located at desired positions on the tube portion 30. The fins 28 can then be secured to the tube portion 30, by a variety of methods. Preferably the fins 28 are attached to the tube portion by a mechanical or interference fit. The openings 22 can be configured so that the end portions 48 deform slightly as a result of the tube passes 38 extending through the openings 22. The deformation of the end portions 48 mechanically retain the fins 28 at desired locations on the tube portion 30 and provide good surface contact between fins 28 and tube portion 30. Alternatively, other methods of attaching the fins 28 to the desired location of the tube portion 30, such as by brazing and/or adhesives, may be employed.

The one or more continuous fins 28 that are made from the universal fin 20 can be separated from the universal fin 20 in a variety of ways. For example, the universal fin 20 can be cut between adjacent rows 26 and/or adjacent columns 24 to form the one or more fins 28 having a desired number of columns 24 and rows 26 of openings 22. Other methods of separating the universal fin 20 between the columns 24 and/or rows 26, as will be apparent to those skilled in the art, can also be employed without departing from the scope of the invention as defined by the claims.

Figure 5:
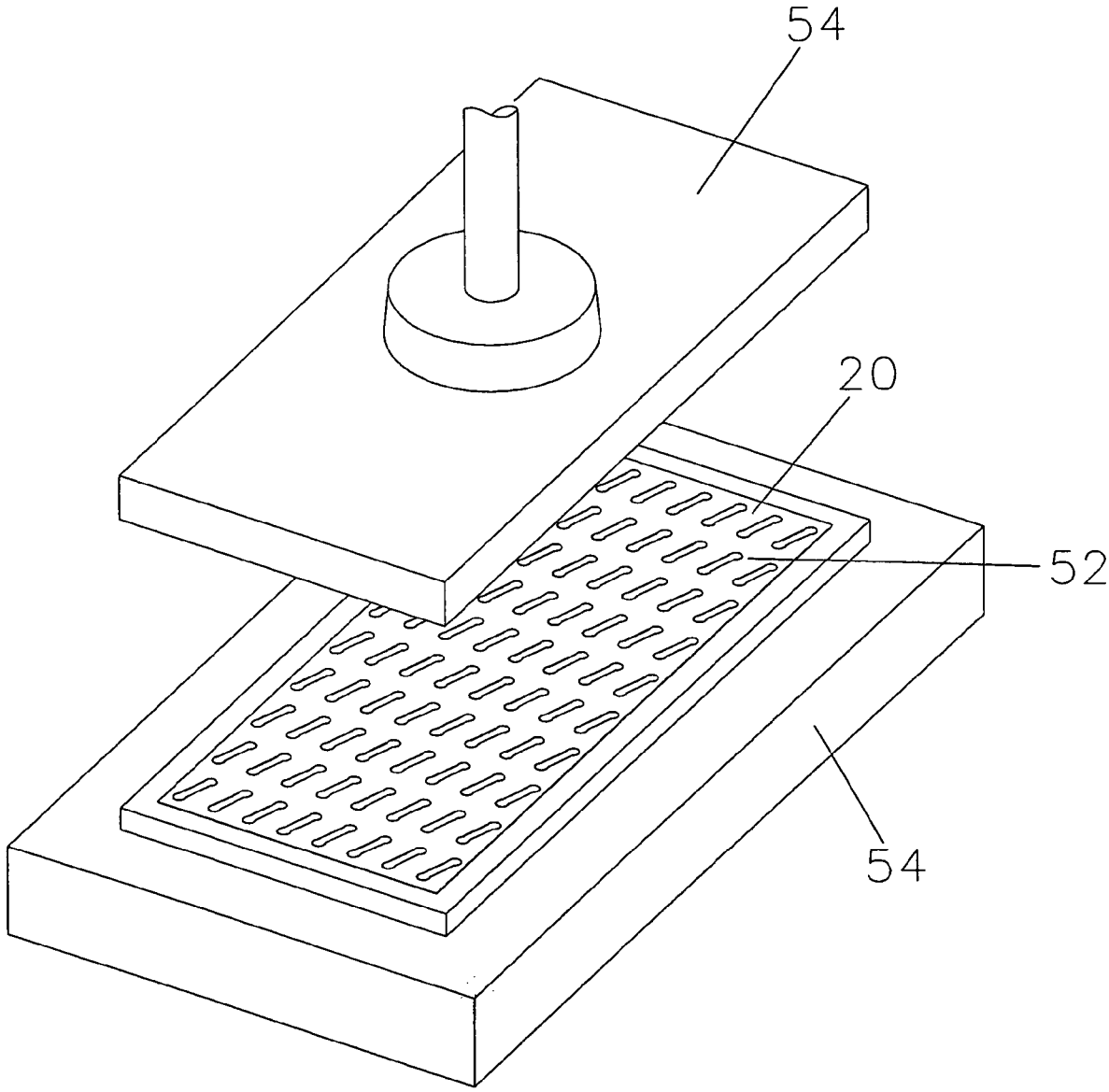
FIG. 5 is a perspective view of a universal fin according to the principles of the present invention being stamped from a sheet of heat conducting material.

The universal fin 20 can be formed by a variety of methods, as will be apparent to those skilled in the art. For example, as shown in FIG. 5, the universal fin 20 can be die stamped from a sheet 52 of heat conducting material. The sheet 52 of heat conducting material is positioned within a die stamp 54. The die stamp then stamps the sheet 52 of heat conducting material into the form of a universal fin 20, as is known in the art.

Figure 6:
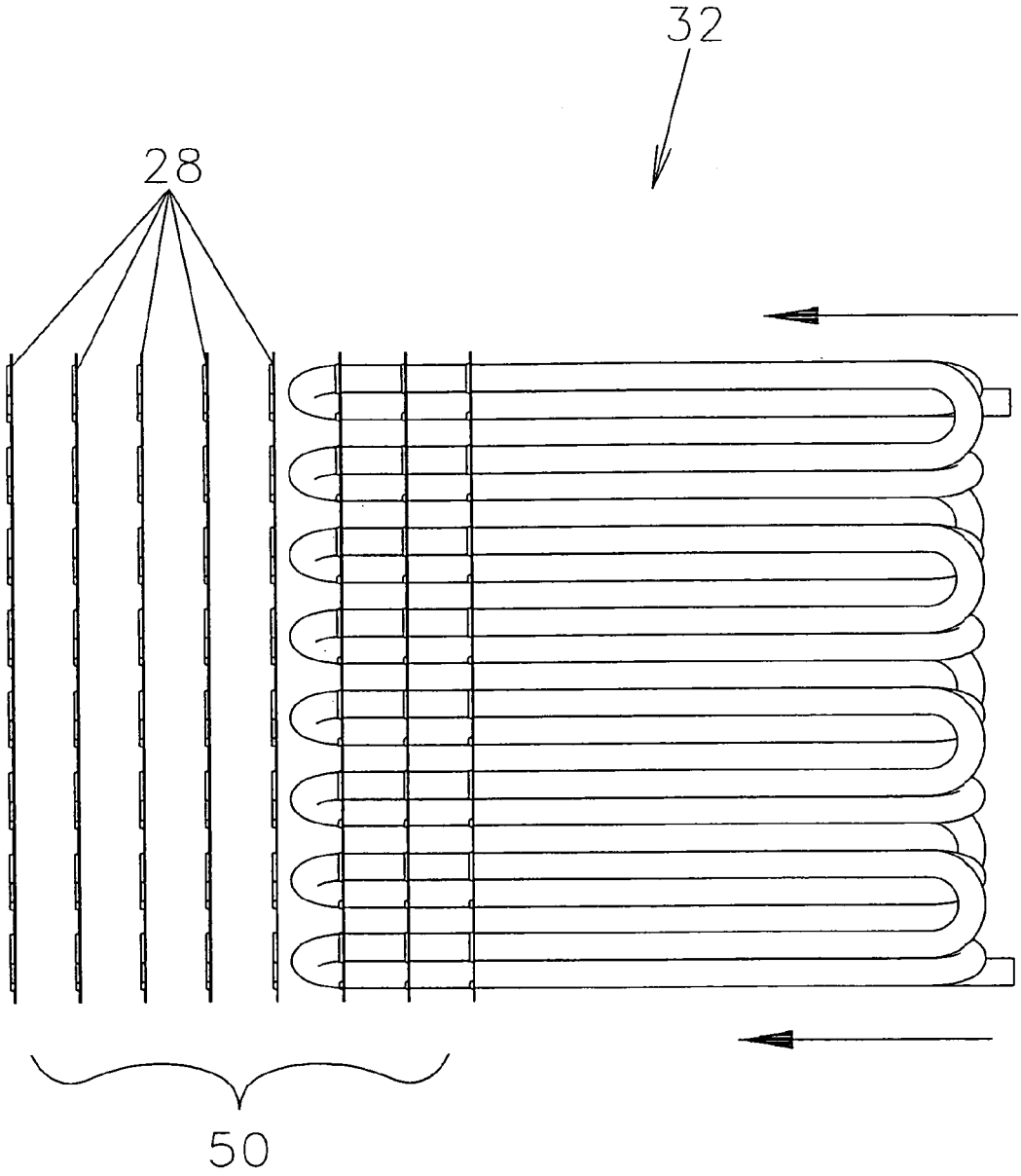
FIG. 6 is a perspective view of continuous fins made from the universal fin of FIG. 1 being arranged on the tube portion of FIG. 2.

As was mentioned above, the configuration of the tube portion 30 in a heat exchanger 32 will vary depending upon the application in which the heat exchanger 32 is desired to be used. For example, when the heat exchanger 32 is desired to be used in a domestic refrigerator, the heat exchanger 32 can be configured to be either an evaporator 56 or a condenser 58. When heat exchanger 32 is configured to be a condenser 58 for application in a machine compartment, the heat exchanger 32 will have a general shape as shown in FIG. 3. The condenser 58 is characterized by having a relatively large inlet for air flow and a short path through the condenser 58 through which the air flows. That is, the condenser 58 will have significantly more vertical tube passes 38 than horizontal tube passes 38 with a horizontal air flow. While the condenser 58 is shown as a 2×8 configuration, it should be understood the actual configuration will vary and such variations are within the scope of the invention. To make the condenser 58, the tube portion 30 is formed into the configuration shown in FIG. 2. Fins 28 having the same number of horizontal rows 26 and vertical columns 24 as the number of horizontal and vertical tube passes 38 (one-half the number of rows 26 and columns 24 as the number of straight segments 34) are removed from the universal fin 20. The plurality of fins 28 and the tube portion 30 are then assembled, as shown in FIG. 6, to form the condenser 58.

The tube portion 30 can also be configured so the heat exchanger 32 takes the form of an evaporator or a condenser 56 for application underneath a refrigerator. The evaporator or condenser 56 is characterized having a relatively small inlet for air flow and a comparably long path through the evaporator or condenser 56 through which the air flows. Therefore, as can be seen in FIG. 4, the evaporator or condenser 56 is characterized by having a significantly larger number of horizontal tube passes 38 than vertical tube passes 38 with a horizontal air flow. While the evaporator or condenser 56 is shown as an 8×4 configuration, it should be understood that the actual configuration will vary and such variations are within the scope of the invention. One or more continuous fins 28, as shown in FIG. 1C, are separated from the universal fin 20 so that the number of rows 26 and columns 24 of openings 22 on the fins 28 equals the number of horizontal and vertical tube passes 38 (one-half the number of rows 26 and columns 24 as the number of straight segments 34) of the tube portion 30. The fins 28 and tube portion 30 are then assembled to form the evaporator 56.

Optionally, but preferably, the spacing between adjacent columns 24 is generally equal to the spacing between adjacent rows 26. When the spacing between adjacent columns 24 and adjacent rows 26 is the same, the tube portion 30 which is configured to use one or more continuous fins 28 from the universal fin 20 has the vertical and horizontal tube passes 38 also equally spaced apart and equal to the spacings between the adjacent columns 24 and adjacent rows 26. The tube portion 30 can then utilize the universal fin 20 to provide one or more continuous fins 28 to be assembled with the tube portion 30 to form a heat exchanger 32 having any desired number of vertical and horizontal tube passes 38.

Figure 8A:
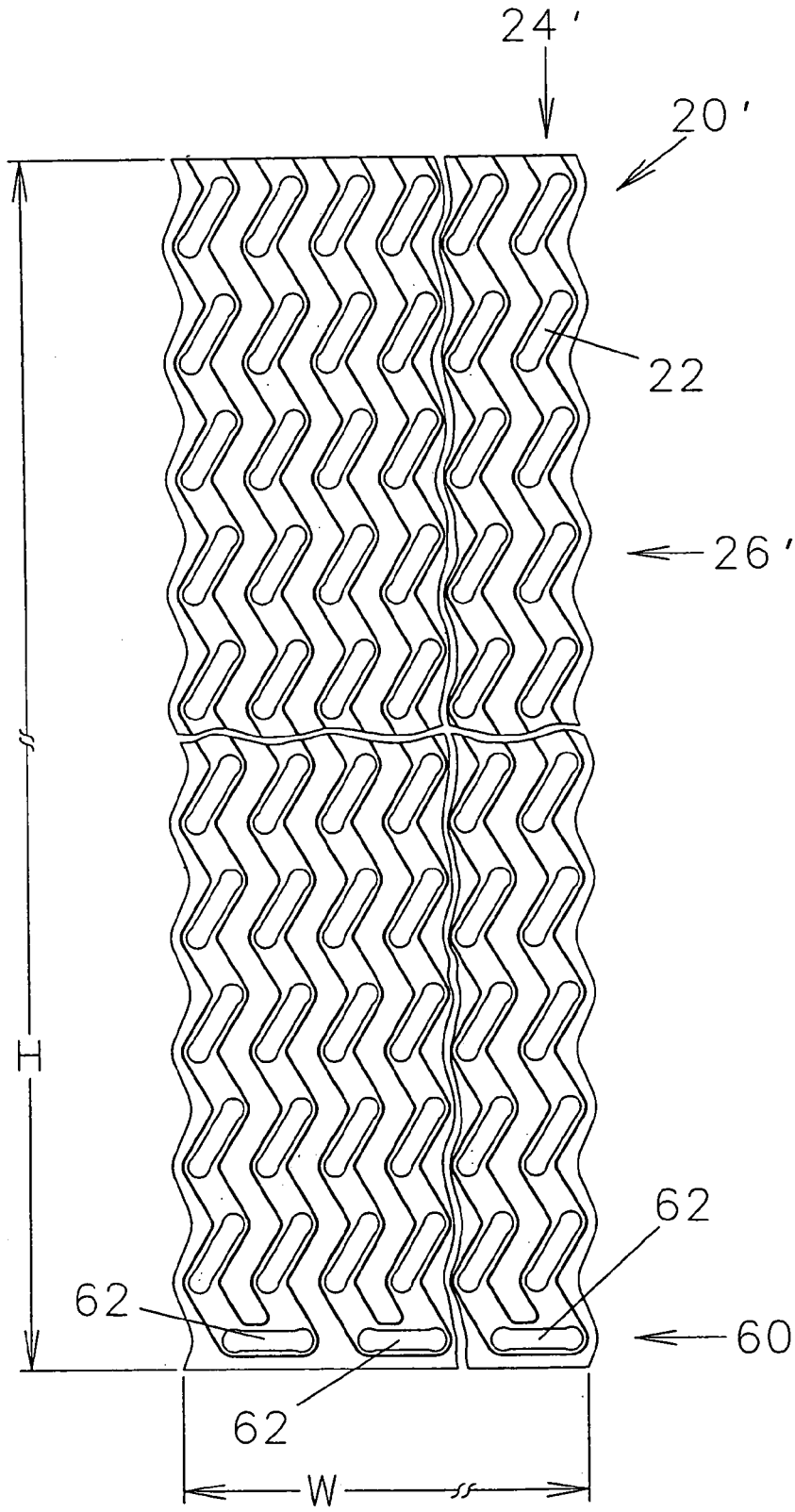
FIG. 8A is a front elevation view of a second preferred embodiment of a universal fin according to the principles of the present invention.
Figures 8B, 8C, 8D:
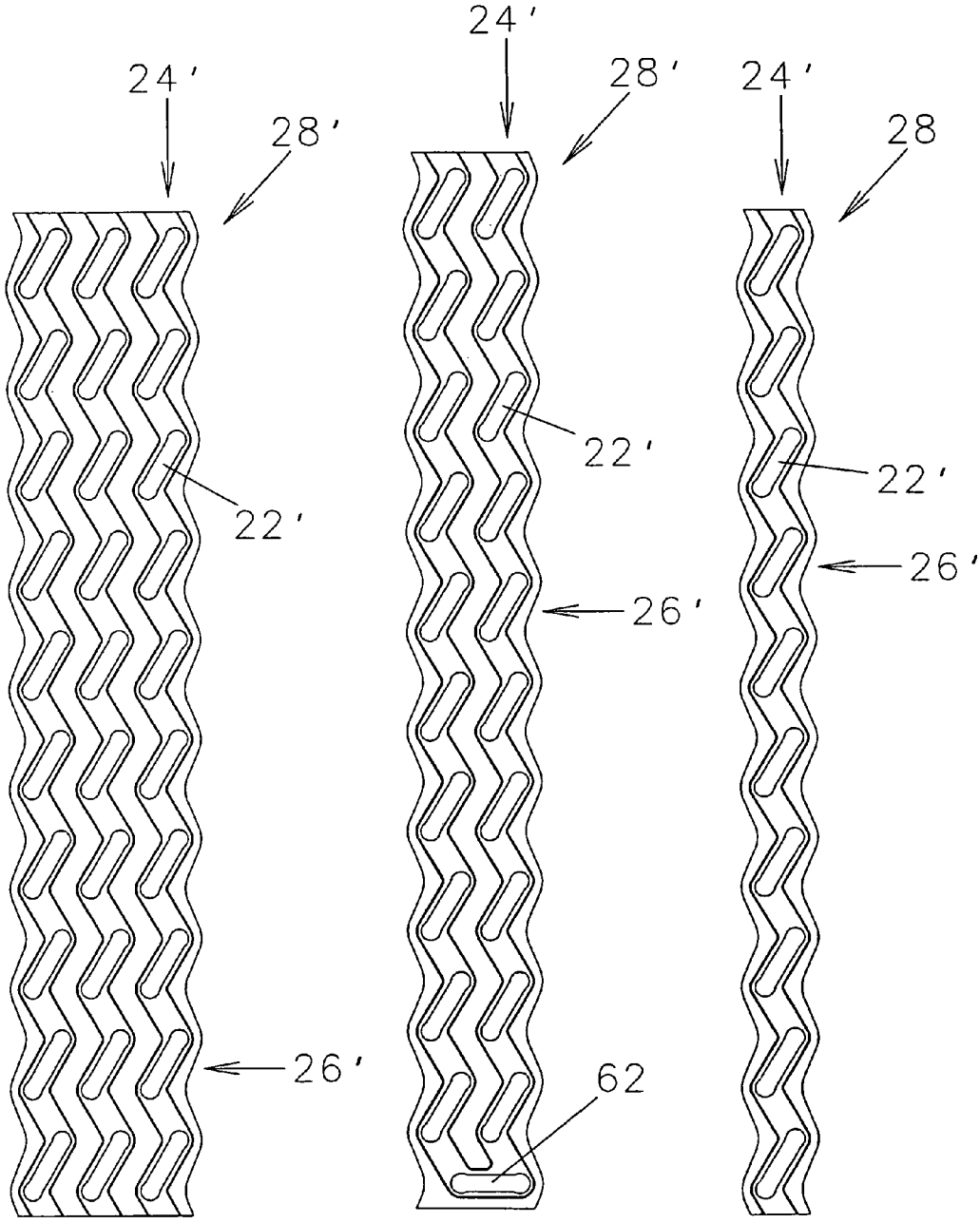
FIGS. 8B–D are front elevation views of exemplary continuous fins that can be formed from the universal fin of FIG. 8A.

Referring now to FIG. 8A, a second preferred embodiment of a universal fin 20' is shown. In this embodiment, the openings 22' are arranged in a tighter configuration such that a straight line cannot be drawn between adjacent columns 24' of openings 22'. That is, openings 22' are canted and the columns 24' are spaced apart a distance such than an upper portion of one of the openings 22' will overlap a lower portion of an opening 22' in an adjacent column 24'. With this spacing between adjacent columns 24', a straight cut between columns 24' is not possible. Rather, adjacent columns 24' are separated by making a scalloped or undulating cut between adjacent columns 24', such as shown in FIGS. 8B–D which are fins 28' of varying number of columns 24' that were cut from universal fin 20' and have undulating edges.

Figure 9:
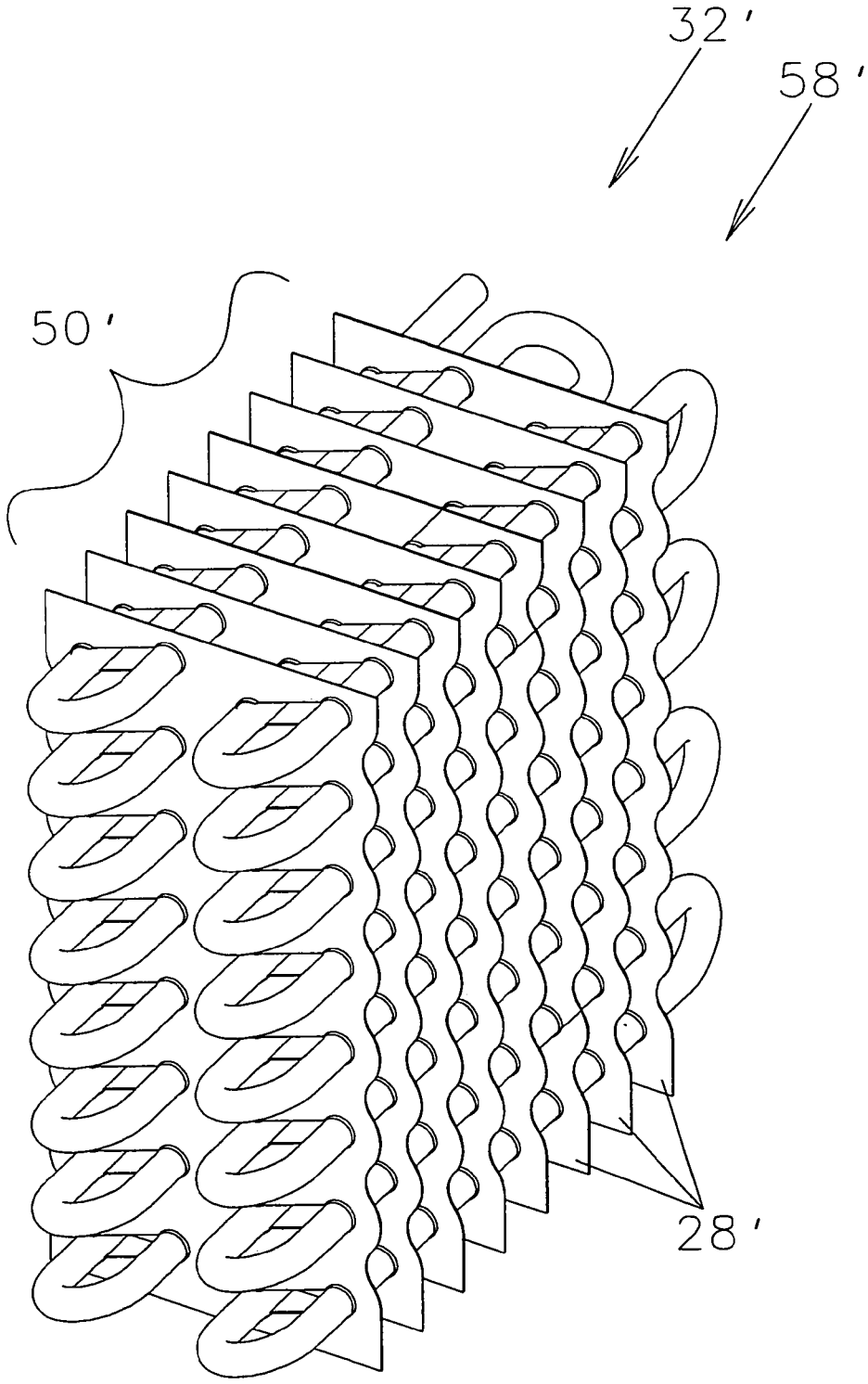
FIG. 9 is a perspective view of a heat exchanger having fins formed from the universal fin according to the second preferred embodiment of the present invention.

The partial overlapping of an opening 22' in one column 24' with an opening 22' in an adjacent column 24' allows for closer spacing between tube passes 38' in a heat exchanger 32' formed with scalloped fins 28', such as the heat exchanger 32' shown in FIG. 9. The universal fin 20' can be cut or separated between adjacent columns 24' and/or rows 26' to form a fin 28' with a desired number of columns 24' and rows 26', such as fins 28' shown in FIGS. 8B–D. Optionally, as shown in FIG. 8A, universal fin 20' can have a lower most row 60 which has a generally horizontal opening 62 for every two columns 24'. Openings 62 are designed to correspond with a tube pass that goes from one column 24' to an adjacent column 24'. Thus, universal fin 20' is substantially the same as universal fin 20 with the positioning of adjacent columns 24' being different along with the optional addition of a lowermost row 60 of openings 62.

As will be apparent to those skilled in the art, the universal fin 20 can be used to provide one or more continuous fins 28, 28' for a variety of configurations of a heat exchanger 32, 32' that has horizontal and vertical tube passes that are spaced apart generally equal to the spacings between the columns 24, 24' and rows 26, 26' of openings 22, 22' in the universal fin 20, 20'. Therefore, while the universal fin 20, 20' has been shown as being able to provide one or more continuous fins 28, 28' for use in a 2×8 configuration and an 8×4 configuration, it should be understood that universal fin 20, 20' can be used to provide fins 28, 28' for n×n configurations, where n is a positive integer, without departing from the scope of the invention as defined by the claims.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A universal fin for use in a fin on tube heat exchanger, the universal fin comprising:

a sheet of heat conducting material configured to be separated to form one or more continuous fins for use on the fin on tube heat exchanger regardless of a number of vertical and horizontal pairs of tubing segments in said heat exchanger, said sheet having a width and a height; and a plurality of openings in said sheet, each of said openings configured to allow a pair of generally parallel tubing segments of the heat exchanger to pass therethrough, each of said openings being canted relative to said width and height of said sheet, each of said openings being arranged on said sheet into a plurality of rows and into a plurality of columns with adjacent rows being generally equally spaced apart and with adjacent columns being generally equally spaced apart, and said spacing between adjacent rows and between adjacent columns being dimensioned to allow said sheet to be separated between at least one of said adjacent rows and said adjacent columns to form one or more continuous fins each containing a plurality of openings at least equal to a total number of pairs of tubing segments in the heat exchanger.

2. The universal fin of claim 1, further comprising indicia on said sheet indicating locations where said sheet can be separated to form said fins, said indicia extending along said sheet between at least one of said columns and said rows.

3. The universal fin of claim 2, wherein said indicia is perforations in said sheet.

4. The universal fin of claim 1, wherein said columns are spaced apart such that a portion of said openings in one of said columns overlaps a portion of said openings in an adjacent column and having an undulating edge.

5. The universal fin of claim 1, wherein said spacing between adjacent rows is generally equal to said spacing between adjacent columns.

6. A fin on tube heat exchanger having a fin formed from a universal fin sheet, the heat exchanger comprising:

a tube portion having a plurality of straight segments of tubing interconnected by a plurality of connecting segments of tubing with each connecting segment interconnecting two straight segments, said straight and connecting segments being arranged in a sinuous configuration, said tube portion having a known quantity of vertical and horizontal pairs of tube passes; and at least one continuous fin on said tube portion, said continuous fin being separated from a universal fin sheet having a width, a height and a plurality of openings with each opening configured to allow a pair of tube passes to pass therethrough, each of said openings being arranged on said universal fin sheet into a plurality of rows and into a plurality of columns with adjacent rows being generally equally spaced apart and with adjacent columns being generally equally spaced apart, and said spacing between adjacent rows and between adjacent columns being dimensioned so that said universal fin sheet can be separated between at least one of said adjacent rows and adjacent columns to form said continuous fin having a quantity of openings at least equal to said number of pairs of tube passes regardless of a number of vertical and horizontal pairs of tube passes in said tube portion, wherein said continuous fin has a quantity of said openings at least equal to said number of pairs of tube passes in said tube portion and said continuous fin is arranged on said tube portion with each pair of tube passes of said tube portion passing through one of said openings in said continuous fin.

7. The heat exchanger of claim 6, wherein said tube portion is a single continuous tube.

8. The heat exchanger of claim 6, wherein said at least one fin is one of a plurality of fins and said plurality of fins are aligned in a generally parallel configuration with said openings in said fins being aligned to form a fin bank that is arranged on said tube portion.

9. The heat exchanger of claim 6, wherein said tube portion has more vertical tube passes than horizontal tube passes.

10. The heat exchanger of claim 6, wherein said tube portion has more horizontal tube passes than vertical tube passes.

11. The heat exchanger of claim 6, wherein said spacing between adjacent rows is generally equal to said spacing between adjacent columns.

12. The heat exchanger of claim 6, wherein said columns of said universal fin sheet are spaced apart such that a portion of said openings in one of said columns overlaps a portion of said openings in an adjacent column and said fin has an undulating edge.

13. A method of making a fin on tube heat exchanger, the method comprising the steps of:

(a) separating at least one continuous fin having a predetermined quantity of openings from a preformed universal fin sheet that is configured to be separated to provide one or more continuous fins for use on a heat exchanger regardless of a number of vertical and horizontal pairs of tube passes in a tube portion of the heat exchanger on which said at least one continuous fin is to be used, said universal fin sheet having a plurality of columns and a plurality of rows of openings configured to allow a pair of tube passes to pass therethrough; and (b) positioning said continuous fin on said tube portion of said heat exchanger with pairs of tube passes passing through said openings.

14. The method of claim 13, wherein (a) includes separating said at least one continuous fin from a universal fin sheet having a width, a height and a plurality of openings with each opening configured to allow a pair of tube passes of the heat exchanger to pass therethrough, each of said openings being arranged on said universal fin sheet into a plurality of rows and into a plurality of columns with adjacent rows being generally equally spaced apart and with adjacent columns being generally equally spaced apart, and said spacing between adjacent rows and between adjacent columns being dimensioned so that said universal fin can be separated between at least one of said adjacent rows and adjacent columns to form said at least one fin regardless of a number of horizontal and vertical pairs of tube passes.

15. The method of claim 14, further comprising preforming said universal fin sheet.

16. The method of claim 15, wherein preforming said universal fin sheet includes placing indicia on said universal fin sheet between at least one of said columns and said rows, said indicia indicating locations where said universal fin sheet can be separated to form said at least one fin.

17. The method of claim 15, wherein preforming said universal fin sheet includes die stamping said universal fin sheet from a sheet of heat conducting material.

18. The method of claim 13, further comprising forming a tube portion having a predetermined number of vertical and horizontal pairs of tube passes.

19. The method of claim 18, wherein forming said tube portion includes forming said tube portion with a greater number of horizontal pairs of tube passes than vertical pairs of tube passes.

20. The method of claim 18, wherein forming said tube portion includes forming said tube portion with a greater number of vertical pairs of tube passes than horizontal pairs of tube passes.

21. The method of claim 18, wherein forming said tube portion includes bending a continuous length of tubing so that said tubing forms said tube portion.

22. The method of claim 13, wherein (a) includes cutting said at least one fin from said preformed universal fin sheet.

23. The method of claim 13, wherein portions of openings in one column overlap portions of openings in an adjacent column and said fin has an undulating edge.

24. A method of assembling fin on tube heat exchangers having differing numbers of horizontal and vertical tube passes using substantially identical universal fin sheets, the universal fin sheets each having a plurality of columns and rows of openings configured to allow a pair of tube passes to pass therethrough, the method comprising:

(a) separating a plurality of first continuous fins having $N_1$ columns and $M_1$ rows of openings from the universal fin sheets, $N_1$ and $M_1$ being positive integers greater than 1; and (b) positioning said first continuous fins on a first tube bundle with tube passes passing through said openings;

separating a plurality of second continuous fins having $N_2$ columns and $M_2$ rows of openings from the universal fin sheets, $N_2$ and $M_2$ being positive integers greater than 1 and at least one of $N_2$ and $M_2$ being different than $N_1$ and $M_1$, respectively, and (d) positioning said second continuous fins on a second tube bundle with tube passes passing through said openings.

25. The method of claim 24, wherein (b) includes positioning said first continuous fins on a first tube bundle having $N_1$ pairs of horizontal tube passes and $M_1$ pairs of vertical tube passes and (d) includes positioning said second continuous fins on a second tube bundle having $N_2$ pairs of horizontal tube passes and $M_2$ pairs of vertical tube passes.

26. The method of claim 25, wherein both $N_1$ and $M_1$ are different than $N_2$ and $M_2$, respectively.

27. The method of claim 24, wherein (a) and (c) include, respectively, separating said first and second continuous fins from universal fin sheets having equally spaced apart columns of openings and equally spaced apart rows of openings.

28. The method of claim 27, wherein (a) and (c) include, respectively, separating said first and second continuous fins from universal fin sheets having equally spaced apart columns of openings and equally spaced apart rows of openings having a spacing substantially the same as said spacing between the columns.

29. The method of claim 24, further comprising forming the universal fin sheets.

30. The method of claim 24, further comprising forming said first and second tube bundles.

* * * * *